US006501426B2

(12) United States Patent
Waterman

(10) Patent No.: US 6,501,426 B2
(45) Date of Patent: Dec. 31, 2002

(54) WIDE SCAN ANGLE CIRCULARLY POLARIZED ARRAY

(75) Inventor: Timothy G. Waterman, Eldersburg, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 79 days.

(21) Appl. No.: 09/850,121

(22) Filed: May 7, 2001

(65) Prior Publication Data

US 2002/0163469 A1 Nov. 7, 2002

(51) Int. Cl.[7] ..... H01Q 1/38
(52) U.S. Cl. ..... 343/700 MS; 343/757; 343/762; 343/876
(58) Field of Search ..... 343/700 MS, 757, 343/762, 767, 772, 876, 878, 879, 893

(56) References Cited

U.S. PATENT DOCUMENTS 3,653,054 A * 3/1972 Wen ..... 333/21 R
5,459,471 A * 10/1995 Thomas ..... 342/175
5,845,391 A * 12/1998 Bellus et al. ..... 29/600
5,943,023 A * 8/1999 Sanford ..... 343/772
6,133,883 A * 10/2000 Munson et al. ..... 343/700 MS
6,222,497 B1 * 4/2001 Hu et al. ..... 343/713
6,313,798 B1 * 11/2001 Bancroft et al. ..... 343/700 MS
6,429,824 B2 * 8/2002 LaRochelle et al. ..... 343/767

* cited by examiner

*Primary Examiner*—Don Wong
*Assistant Examiner*—Shih-Chao Chen
(74) *Attorney, Agent, or Firm*—Birch, Stewart, Kolasch & Birch, LLP

(57) ABSTRACT

An array of dual trough radiator elements including orthogonally crossed trough waveguide cavities and RF feed members of predetermined adjustable length extending across the cavities from one radiator element to its neighbor, where the feed members are suspended in a slot formed in the body radiator elements and where the inner or proximal ends are connectable to an RF energy source while the outer or distal end is unconnected in an open circuit arrangement. The array also includes intermediate support members of electrical insulation located on an outer surface of the radiator element and a switchable parasitic ground plane consisting of a set of parasitic conductor elements is located on a top surface of the intermediate support member.

23 Claims, 3 Drawing Sheets

WIDE SCAN ANGLE CIRCULARLY POLARIZED ARRAY

BACKGROUND OF THE INVENTION

1. Field of the Invention

This invention relates generally to RF antennas and more particularly to an array of dual trough radiating elements capable of scanning from broadside to endfire.

2. Description of Related Art

Circularly polarized antenna arrays for radiating electromagnetic energy at microwave frequencies are generally known. However, scanning a circular polarized antenna including trough radiating elements is more difficult to achieve than scanning a specific polarization due to the greatly different aspects that each component wave, vertical and horizontal polarization, sees over the scanned volume. For example, even if the elements have the same phase center, i.e., physical location, each polarization's phase shift to the far field is likely to be vastly different at or near endfire as compared to broadside radiation, the reason being the attenuation of each polarization is different as is shown in FIG. 1. In FIG. 1, a horizontally polarized signal tends to be shorted out as it propagates near a conducting surface, such as a ground plane, while the vertical polarization signal propagates relatively unattenuated. Thus, endfire radiation which comprises RF energy radiated coplanar with the ground plane is severely restricted due to the attenuation of the horizontally polarized signal.

SUMMARY OF THE INVENTION

The above-noted attenuation problem near endfire is solved by the subject invention in two ways: (a) by using a trough or notch radiator whose launch point is already a quarter wavelength up from ground, and (b) by utilizing a switchable parasitic ground plane structure in connection with switchable circuit elements that are activated or turned on when a beam to be radiated is scanned to or near endfire while being turned off for broadside radiation.

The present invention in its principal aspect is directed to a circularly polarized trough antenna, which is comprised of: an array of dual trough radiator elements including orthogonal trough waveguide cavities and RF feed members of predetermined adjustable length extending across the cavities from one radiator element to its neighbor, where the feed members are suspended in a slot formed in the body radiator elements and where the inner or proximal end is connectable to an RF energy source while the outer or distal end is unconnected in an open circuit arrangement; intermediate support members of electrical insulation are located on an outer surface of the radiator elements; and a parasitic ground plane structure consisting of a set of parasitic conductor elements are located on a top surface of the intermediate support members so as to enable scanning of the array to or near endfire when energized. In a preferred embodiment, the parasitic conductor elements are connectable to a source of electrical potential by a switching circuit arrangement.

Further scope of applicability of the present invention will become apparent from the detailed description provided hereinafter. It should be understood, however, that the detailed description and specific example, while disclosing the preferred embodiment of the invention, is given by way of illustration only inasmuch as various changes and modifications coming within the spirit and scope of the invention will become apparent to those skilled in the art from the detailed description.

BRIEF DESCRIPTION OF THE DRAWINGS

The present invention will become more fully understood when considered in conjunction with the accompanying drawings which are supplied for purposes of illustration only, and thus are not meant to be limitative of the subject invention, and wherein.

DETAILED DESCRIPTION OF THE INVENTION

Figure 1:
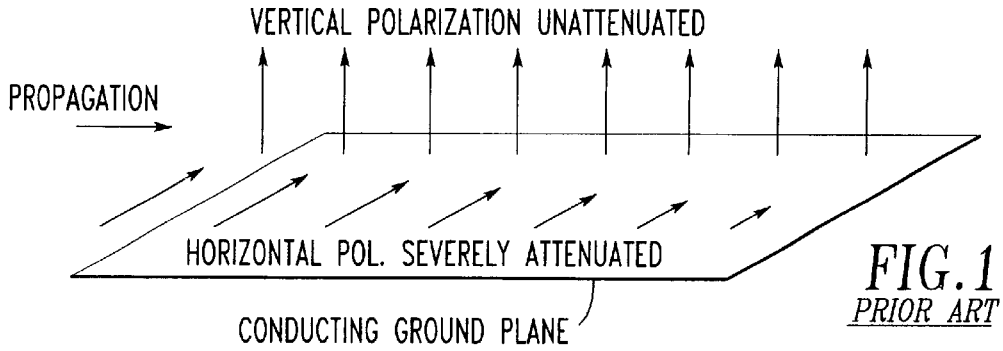
FIG.1 PRIOR ART
FIG. 1 is a diagram illustrative of the attenuation of vertical and horizontally polarized waves propagating near a conductive surface.
Figure 2:
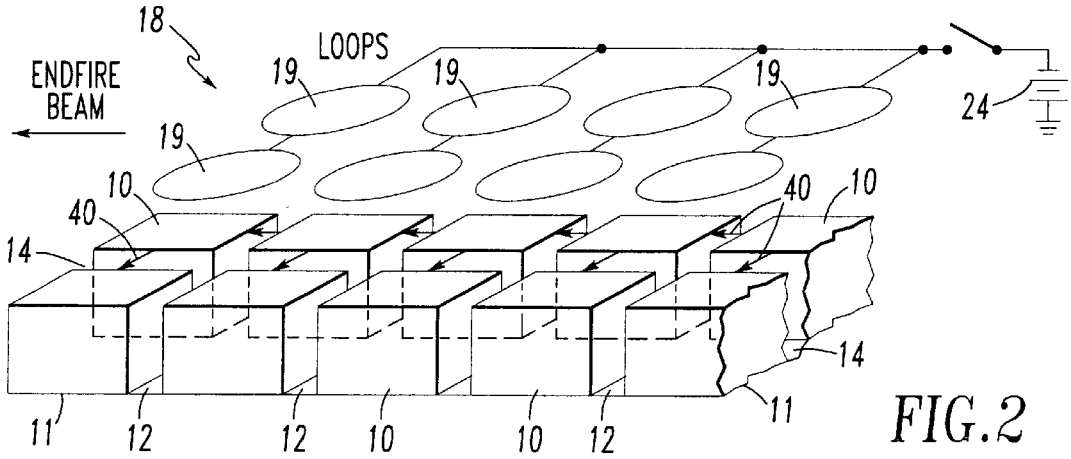
FIG. 2 is a diagram generally illustrative of the principle of the subject invention propagating energy in an endfire mode.

Referring now to the figures wherein like reference numerals refer to like elements, FIG. 2 depicts an electrical block diagram broadly illustrative of the subject invention. Shown thereat is a rectilinear array of dual trough radiator elements 10 mounted on a ground plane 11 and mutually separated by adjacent orthogonal trough waveguide cavities 12 and 14. In FIG. 2, neighboring, i.e., immediate adjacent radiator elements 10, have RF feed members 16 located a quarter wavelength above the ground plane and which extend transversely across the cavities 12 and 14 so as to provide respective drive points for RF energy radiated by the array from the cavities 12 and 14.

Figure 3:
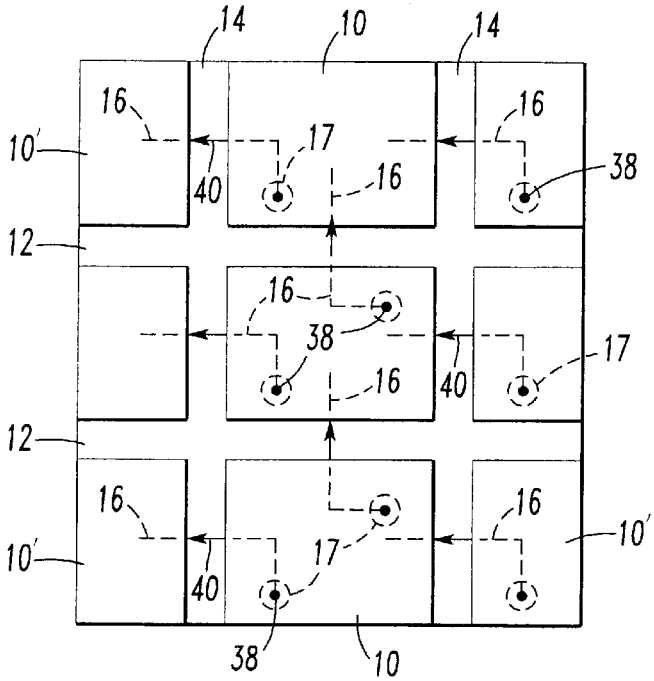
FIG. 3 is a top planar view broadly illustrative of a dual trough array in accordance with one embodiment of the invention.

This is further shown in FIG. 3 wherein an array of full sized radiator elements 10 includes left and right side sections consisting of half sized radiator elements 10' and the feed elements 16 connected to respective RF connectors 17 and which extend between the neighboring radiator elements 10 and 10'.

The invention also utilizes a parasitic ground plane 18 above the trough radiators 10. As shown in FIG. 2, the parasitic ground plane 18 consists of individual circular ground plane elements or conductive loops 19 located above the radiator elements 10.

As shown in FIG. 2, the parasitic ground plane members 19 are connectable to a source of electrical potential 24. The same is true for the array shown in FIGS. 4 and 5. Accordingly, when a beam is generated by the array is scanned to or near endfire, meaning that the energy is propagated in a plane parallel to the ground plane 11, the parasitic elements 19 are turned on, i.e., activated or energized by the source 24. When the array is scanned to broadside, meaning that the beam is scanned outwardly perpendicular to the ground plane 11, the parasitic elements are off, i.e, unenergized and thus become electrically invisible from the energy generated in the troughs 12 and 14 by the feed members 16.

Figure 4:
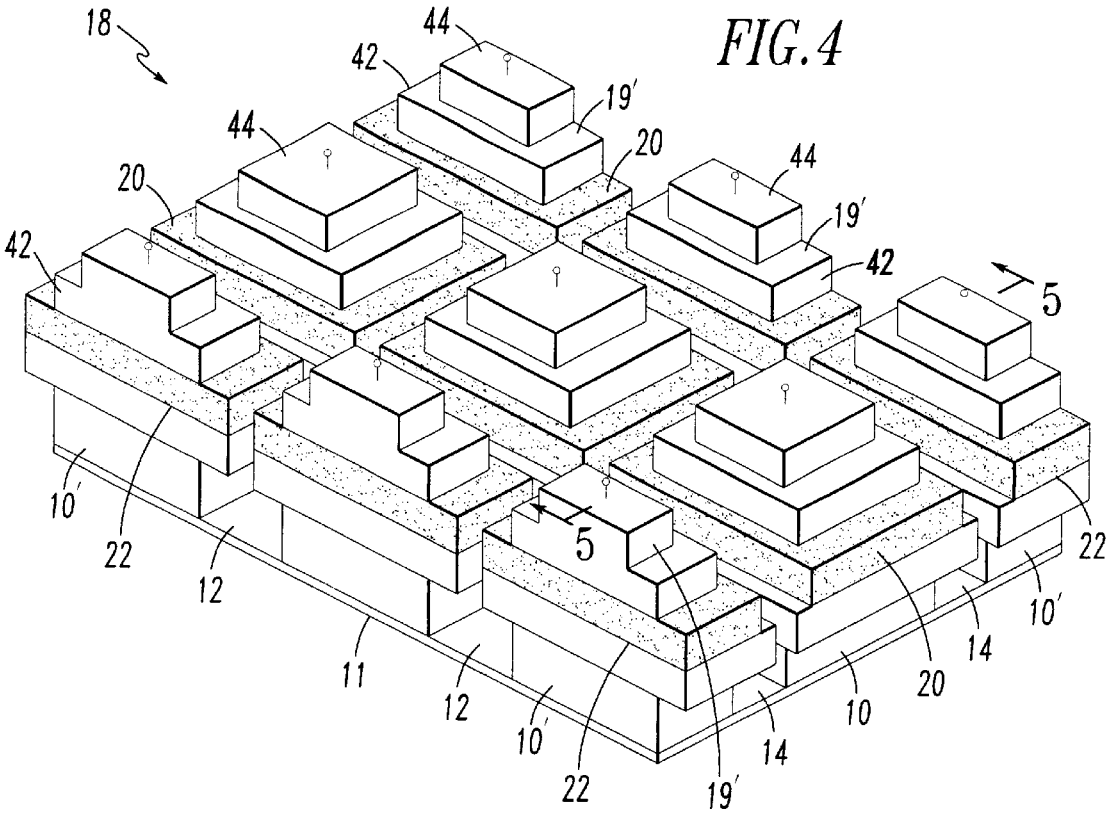
FIG. 4 is a perspective view generally illustrative of the preferred embodiment of the invention.
Figure 5:
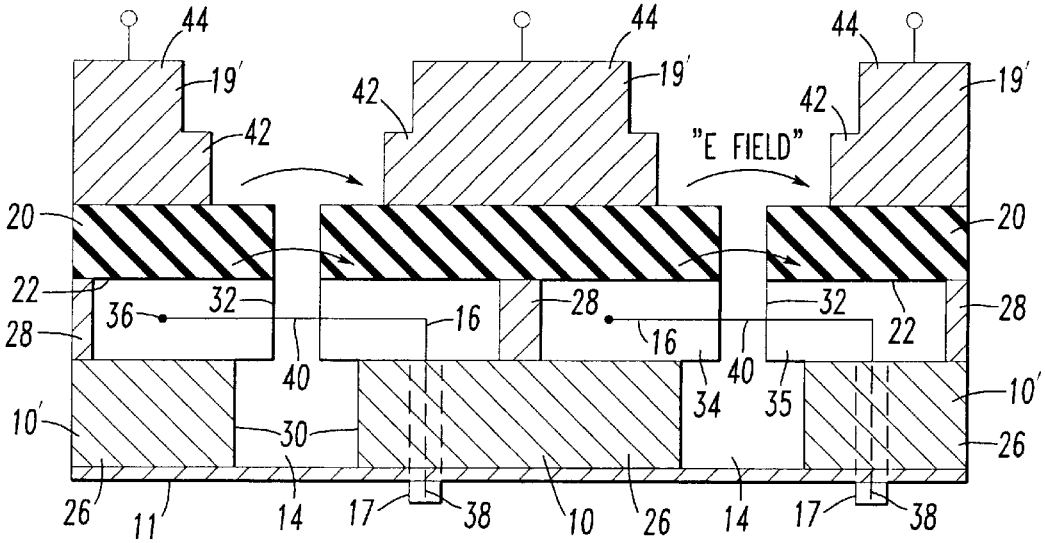
FIG. 5 is a vertical cross section of the embodiment of the invention shown in FIG. 4, taken along the lines 5—5 thereof.

In a preferred embodiment of the invention, the parasitic ground plane 18, as shown in FIGS. 4 and 5, is comprised of two-tiered blocks 19' of metallization located on generally rectangular sections 20 of insulating material of constant thickness which are mounted on the top or outer surface 22 of the radiator elements 10 and 10'. A typical example of the material for the support members 20 is polyurethane foam; however, it should be understood that any other suitable insulating material may be utilized, such as polystryrene foam or polyethylene foam. What is important is that the material have sufficient strength to support the parasitic ground plane members 19' which serve as major components in the invention.

Referring now to FIGS. 4 and 5, where FIG. 5 is a transverse cross section of the array shown in FIG. 4 taken along the lines 5—5, the radiator elements 10 and 10' comprise two-tiered layers of metallization 26 and 28 with mutually opposing lower and upper sidewalls 30 and 32, with the sidewalls 32 having a separation distance less than the separation distance of the sidewalls 30 and 32. These distances define the size of the cavities 14 as well as the orthogonal cavities 12 (FIG. 4). As shown in FIG. 5, the RF feed members 16 are comprised of right angled stripline conductor members which are suspended a quarter wavelength above the ground plane 11 in opposing slots 34 and 35 formed in the body of the radiator elements 10 and 10'. The outer or distal ends 36 of the stripline conductor members are open circuited, i.e., they are not connected to any conductive wall surface of the respective slot 34, while the inner or proximal end 38 is connected to an RF connector 17 (FIG. 2). The length 40 of the stripline conductors 16 between the narrower sidewalls 32 define launch points of the RF energy radiated.

Further as shown, the parasitic ground plane conductors 19' are located at a predetermined constant separation distance above the radiator elements 10 and 10'. As shown, they include lower regions 42 and upper regions 44, where the lower regions 42 have a length and width dimension, as shown in FIG. 4, which is greater than the length and width dimensions of the upper regions 44. These parasitic elements operate to enhance the propagation of the tangential E-field when the array is at or near endfire while acting electrically as a simple transformer when the array is scanned broadside.

Such an arrangement provides a well matched array capable of circular polarization of a wide scan angle, from broadside to endfire, while allowing near perfect circular polarization in the peak of the radiated beam of a full $2\Pi$ steradians, i.e., a full hemispherical volume with the appropriate phase shifter settings on each polarization.

Figure 6:
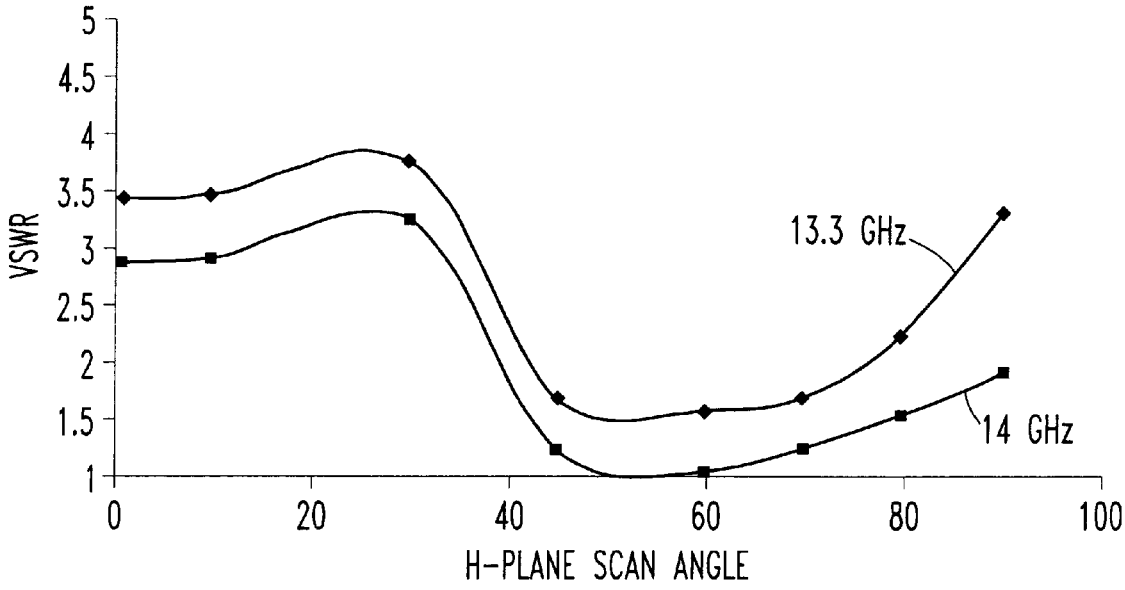
FIG. 6 is a set of characteristic curves illustrative of voltage standing wave ratio (VSWR) vs. H-plane scan angle for the embodiment of the invention shown in FIG. 1 at two different operating frequencies.
Figure 7:
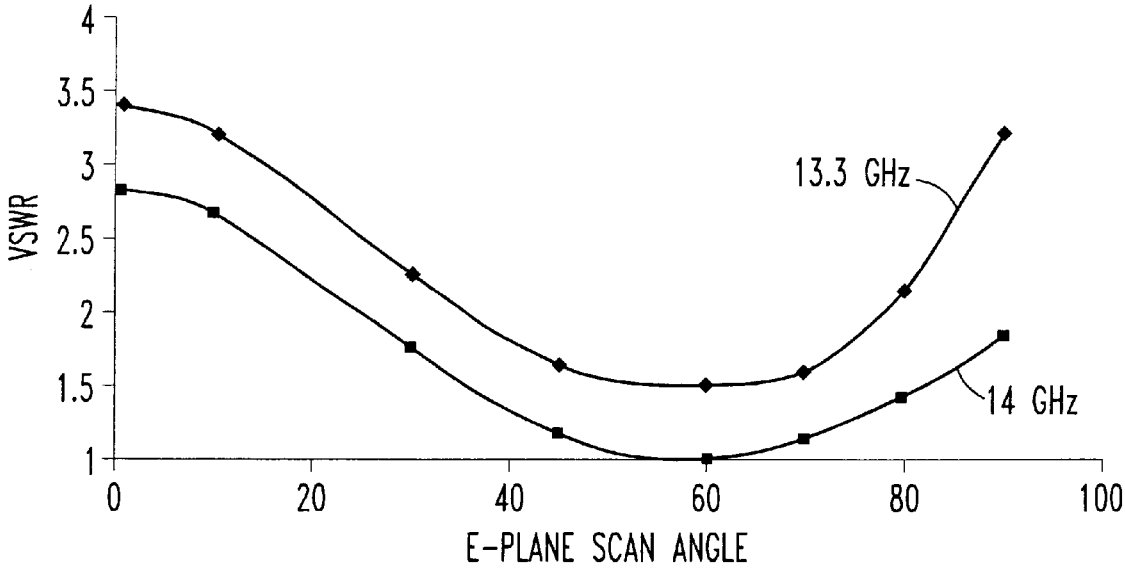
FIG. 7 is a set of characteristic curves illustrative of the VSWR of the invention shown in FIG. 3 vs. E-plane scan angle at the same two operating frequencies.

An electromagnetic model of the embodiment of the invention in an infinite array environment was constructed and scanned in the "H" plane and "E" plane from broadside (0°) to near endfire (85°) as shown in FIGS. 6 and 7. The voltage standing wave ratio (VSWR) was plotted for two frequencies, 13.3 GHz and 14 GHz. VSWR is a measure of the amount of energy reflected when the array is driven by a constant impedance generator. VSWR's near 3:1 or less is considered acceptable over this wide of a scan volume. It can be seen that this invention substantially meets this criterion at 14 GHz.

The foregoing detailed description merely illustrates the principles of the invention. It will thus be appreciated that those skilled in the art will be able to devise various arrangements which, although not explicitly described or shown herein, embody the principles of the invention and thus are within its spirit and scope.

What is claimed is:

1. A trough radiator antenna, comprising:

an array of trough radiator elements located on a ground plane and including crossed trough waveguide cavities between the radiator elements and having RF feed members extending across the cavities from one radiator element to an adjacent radiator element and where one end thereof is connectable to a source of RF energy and the other end is open circuited:

an array of intermediate support members of electrical insulation selectively located on an outer surface of the radiator elements; and parasitic ground plane means located on a top surface of the intermediate members and connectable to a source of electrical potential so as to enable scanning of the array of trough radiator elements to or near endfire when activated by an electrical potential.

2. A trough radiator antenna according to claim 1 wherein said parasitic ground plane means comprises a set of conductor elements located on the top surface of a predetermined number of the intermediate support surfaces.

3. A trough radiator antenna according to claim 1 wherein the array of intermediate support members comprise respective support members located on an outer surface of all the radiator elements.

4. A trough radiator antenna, comprising:

an array of dual trough radiator elements located on a ground plane and including crossed trough waveguide cavities between the radiator elements and having RF feed members extending, across the cavities from one radiator element of said array to another a quarter wavelength above the ground plane in mutually opposing slots formed in the respective radiator elements so as to provide RF drive points and where the proximal end is connectable to a source of RF energy and where the distal end is open circuited;

intermediate support members of electrical insulation located on an outer surface of the radiator elements; and switchable parasitic ground plane means consisting of a set of parasite conductor elements located on a top surface of the intermediate support members and connectable to a source of electrical potential so as to enable scanning of the array to or near endfire when an electrical potential is applied thereto.

5. A trough radiator antenna according to claim 4 wherein the array of radiator elements comprises a rectilinear array.

6. A trough radiator antenna according to claim 5, said crossed trough waveguide cavities comprise orthogonal trough waveguide cavities.

7. A trough radiator antenna according to claim 6 wherein said radiator elements are generally rectangular in configuration.

8. A trough radiator antenna according to claim 7 wherein the intermediate support members are generally rectangular in configuration.

9. A trough radiator antenna according to claim 8 wherein the parasitic conductor elements are generally rectangular in configuration.

10. A trough radiator antenna according to claim 4 wherein the feed members extend transversely across respective cavities and parallel to the ground plane.

11. A trough radiator antenna according to claim 10 wherein the waveguide cavities include upper and lower substantially linear sidewalls having a first separation distance and a second separation distance.

12. A trough radiator antenna according to claim 11 wherein the first separation distance is less than the second separation distance.

13. A trough radiator antenna according to claim 12 wherein the feed members extend between the upper sidewalls of the cavities.

14. A trough radiator antenna according to claim 4 wherein the crossed waveguide cavities are mutually aligned in rows and columns.

15. A trough antenna according to claim 4 wherein the feed members are comprised of stripline conductors.

16. A trough antenna according to claim 4 wherein the intermediate support members of electrical insulation are comprised of material selected from a group consisting of polyurethane foam, polystyrene foam and polyethylene foam.

17. A trough antenna according to claim 4 wherein the intermediate support members have a substantially constant thickness.

18. A trough antenna according to claim 4 wherein the parasitic conductive elements comprise blocks of conductive material.

19. A trough antenna according to claim 18 wherein the blocks of conductive material include a lower region and an upper region and where the lower region has length and width dimension greater than length and width dimension of the upper region.

20. A method of enhancing the propagation of the tangential E fields of an array of trough radiators at or near endfire propagation comprising the steps of:

locating parasitic ground plane means above the trough radiators; and energizing or activating the parasitic ground plane means when a beam generated by the array is scanned to or near endfire.

21. A method according to claim 20 and additionally including the step of deenergizing the parasitic ground plane means when the beam is scanned broadside.

22. A method according to claim 21 wherein the parasitic ground plane means is comprised of a set of conductor elements located a predetermined distance away from the trough radiators.

23. A method of enhancing the propagation of the tangential E fields of an array of trough radiators at or near endfire propagation comprising the steps of:

locating a set of parasitic ground plane conductor elements above the trough radiators;

energizing or activating the parasitic ground plane conductor elements when a beam generated by open circuited feed elements of the array is scanned to or near endfire; and deenergizing the set of parasitic ground plane conductor elements when the beam is scanned broadside, thereby providing enhanced circular polarization in the peak of the beam over a hemispherical scan volume.

* * * * *